United States Patent [19]

Ikuma

[11] Patent Number: 5,060,015

[45] Date of Patent: Oct. 22, 1991

[54] AIR FLOW CONTROLLING SYSTEM FOR AN IMAGE RECORDING APPARATUS

[75] Inventor: Akihiro Ikuma, Hachioji, Japan

[73] Assignee: Konica Corporation, Tokyo, Japan

[21] Appl. No.: 625,215

[22] Filed: Dec. 10, 1990

[30] Foreign Application Priority Data

Dec. 14, 1989 [JP] Japan ..... 1-324506

[51] Int. Cl.[5] ..... G03G 21/00; B65H 29/32

[52] U.S. Cl. ..... 355/215; 271/197

[58] Field of Search ..... 355/200, 215, 30, 245, 355/298; 250/582; 271/195, 196, 197

[56] References Cited

U.S. PATENT DOCUMENTS

| | | | |
|---|---|---|---|
| 3,685,485 | 8/1972 | Kutsuwada et al. | 355/215 X |
| 4,154,521 | 5/1979 | Tanaka | 355/215 |
| 4,530,589 | 7/1985 | Adams | 355/215 |
| 4,853,735 | 8/1989 | Kodama et al. | 355/215 |
| 4,995,307 | 2/1991 | Floyd | 98/34.5 |

*Primary Examiner*—A. T. Grimley
*Assistant Examiner*—Nestor R. Ramirez
*Attorney, Agent, or Firm*—Frishauf, Holtz, Goodman & Woodward

[57] ABSTRACT

An air flow control system for an image recording apparatus such as electrophotographic copying machines, includes an image recording device on which an electrostatic image is formed on the surface of a rotational image retainer. This image is developed to obtain a toner image. The toner image is then transferred to a recording medium which is brought into contact with the image forming surface, and the recording paper is then carried to a fixing device by a carrier device. A first suction inlet is positioned to prevent dispersion of the toner used in developing the toner image. A second suction inlet is positioned in the carrier device to provide suction to carry the recording medium. Air flow is dynamically controlled for both the first and second suction inlets, depending on whether a detector senses the presence or absence of the recording medium.

3 Claims, 1 Drawing Sheet

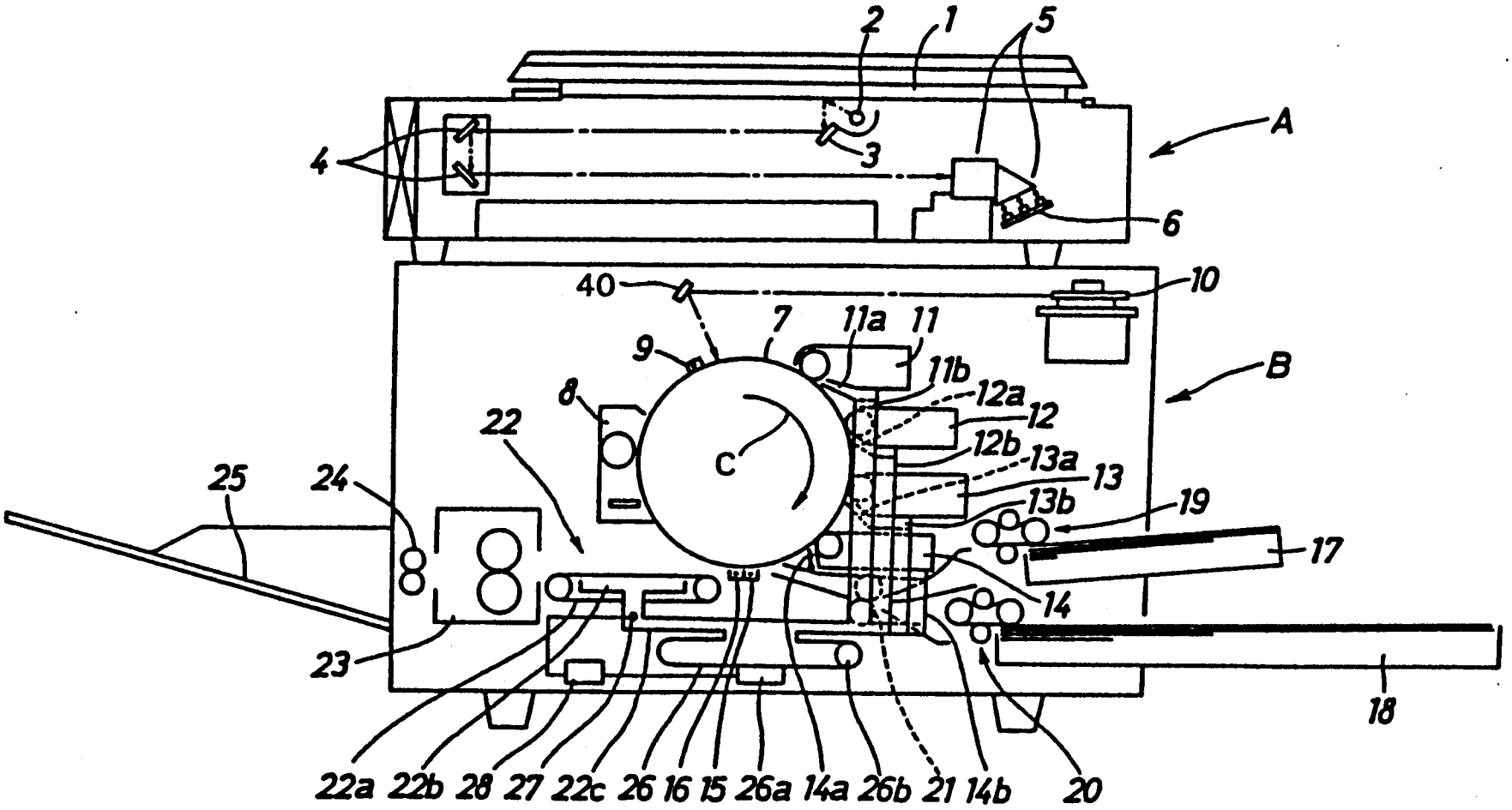
A
B
C
1
2
3
4
5
6
7
8
9
10
11
11a
11b
12
12a
12b
13
13a
13b
14
14a
14b
15
16
17
18
19
20
21
22
22a
22b
22c
23
24
25
26
26a
26b
27
28
40

AIR FLOW CONTROLLING SYSTEM FOR AN IMAGE RECORDING APPARATUS

BACKGROUND OF THE INVENTION

1. Field of the Invention

The present invention relates to an image recording apparatus such as electrophotographic copying machine, and in particular, relates to an image recording device in which an electrostatic image formed on a surface of a rotational image retainer is developed to get a toner image by means of a developing device. The toner image is transferred on to a recording paper which is fed to come in contact with the image forming means surface, and the recorded paper is fed to a fixing device by means of a carrier device.

2. Description of Prior Art

Some prior art image recording devices provide suction in the developing device for preventing toner dispersion into the lower side (in rotational direction) of the image retainer and for allowing a carrier device to suck the recording paper for carrying. In the above mentioned conventional image recording device, a separate air blower is provided for suction in each of the developing device and the carrier device.

Assuming that a common air blower was used in the prior art to achieve the above mentioned suction in the developing device and the carrier device, the suction of the developing device would be too strong, when the carrier device sucks the recording paper for carrying, thereby deteriorating toner images, formed on the image retainer. On the other hand, if the carrier device does not suck the recording paper, sufficiently toner dispersion can not be prevented.

SUMMARY OF THE INVENTION

It is an object to the present invention to provide an improved image recording apparatus in which the developing device are and the carrier device both provided with suction from a common air blower and toner dispersion is prevented without any deterioration of the toner image whether or not the carrier device sucks the recording medium.

BRIEF DESCRIPTION OF THE DRAWING

Accompanying drawing shows a schematic structure of the image recording apparatus of the invention.

DETAILED DESCRIPTION OF PREFERRED EMBODIMENT

The present invention will be described with reference to accompanying drawing.

The FIGURE is a side view of the schematic structure of the digital color image recording apparatus of the present invention. The present invention is not restricted to this example, since it is possible to use it in an analogue image recording apparatus and to a monochrome image recording apparatus having one developing device.

In the image recording apparatus as shown in the drawing, image recording is achieved as indicated in the following description.

When an original is set on a platen 1 of an original reading device A the copying operation starts in a color mode. An image retainer 7 of an image forming device B rotates in the direction of the arrow C. Then, a cleaning device 8 cleans the surface of the image retainer 7, and a charger 9 charges the cleaned surface uniformly.

On the other hand, an exposure lamp 2 of the original reading device A exposes the surface of the original document, and the resulting reflected light is received by a color image sensor 6 by means of first mirror 3, a V mirror 4, a color separating image-forming means 5. Separated color image signals, for example, yellow (Y), magenta (M), and cyan (C), and a black image signal (BK) are obtained from the image signal output of the color image sensor 6.

A laser beam scanner 10 positioned on a side of the image forming device B, modulates a laser beam with, for example, a (Y) image signal. This modulated signal is from laser scanner 10 is projected onto the uniformaly charged surface of the image retainer 7 using a polygon mirror 40 and, so that an electrostatic image having a dot structure is formed. A developing device 11 using a (Y) toner as a developer develops the electrostatic image to obtain a (Y) toner image by a non-contact reversal developing method. The (Y) toner image forming surface passes through the stations of the other developing device 12 to 14, transfer apparatus 15, separator 16, and the cleaning device 8, which are in the non-operating condition. The charger 9, then again charges the image forming surface uniformly with the (Y) toner image thereon.

The exposure lamp 2 then sequentially exposes the original for obtaining, (M), (C), and (BK) signals as above.

Next, the laser beam is modulated by, for example, the (M) image signal and is projected onto the (Y) toner image on retainer 7. The developing device 12 using (M) toner as a developer develops the resulting electrostatic image into a (M) toner image. Thus, a two color image comprising the (Y) toner image and the (M) toner image are formed. When the two color image forming surface reaches the position of the charger 9, the charger 9 charges it uniformly again, and the laser beam modulated by a (C) image signal is then projected onto the uniformly charged surface of retainer 7 to form the (C) electrostatic image. The developing device 13 using a (C) toner as a developer develops the electrostatic image to obtain a (C) toner image. Thus, a three color image comprising (Y), (M), (C) toner images is formed on the image forming surface. These three color images, can then be transferred to the recording paper; or a four color image can be formed by uniformly charging the image forming surface having the three color image formed thereon, with the incident laser beam modulated by a (BK) signal which is then developed by the developing device 14 using a (BK) toner as a developer. The four color image can then be transferred to the recording paper which is fed from a feeder cassette 17 or 18 by means of a feeding means 19 or 20 so as to come in contact with the image retainer 7 by the function of the transfer device 15 and by a register roller 21. The recording paper is separated from the image retainer 7 by the separator 16, and then is fed to the fixing device 23 by a carrier device 22 using a conveyor belt **22*a*. The color image is fixed by a thermal roller of a fixing device 23 and is exhausted on a paper delivery tray 25 by means of a paper delivery roller 24**.

The developing devices 11 to 14 in the present recording apparatus are provided with suction ducts **11*a* to 14*a* whose suction ports are open, at the lower edge of the downstream side of (in the rotational direction) of an open portion where a developer carrier is arranged to carry developer on the circumference thereof. These suction ducts 11***a* to 14*a* are coupled to the suction side of an air blower 26 by means of connecting tubes 11*b* to 14*b*. As to the carrier device 22, the conveyor belt 22*a* has pores and a suction duct 22*b* is provided under the conveyor belt 22*a* . The suction duct 22*b* is coupled to the suction side of the same air blower 26 by a connecting tube 22*c*.

The suction of the air blower 26 can be reduced when the carrier device 22 sucks the recording paper. In order to do this, a pressure sensor 27 for detecting static pressure is provided in the connecting tube 22*c*, in the suction ducts 11*b* to 14*b*, or in the suction side of the air blower 26. The number of revolution of motor 26*a* of the air blower 26 and the size of the opening 26*b* in the exhaust side of the air blower 26 are changed by a control device 28 which senses the change of the static presssure so that the static pressure obtained from the pressure sensor 27 becomes constant, thereby controlling the air blast amount automatically. Besides, a detector for sensing the recording paper can be provided in an inlet portion of the carrier device 22 to control the air blower on the basis of the thus detected data and on time data. Thus, it is possible to obtain a stable toner image on the image retainer 7, without toner dispersion. It is also possible to prevent different color toners from entering each of a plurality of developing device 11 to 14, whether or not the carrier device sucks and carries a recording paper.

On the other hand, if the number of revolution of the motor 26*a* of the air blower 26 and the restriction of the opening 26*b* in the exhausted side are made to be constant, in order to prevent toner dispersion and the mixing of the different color toners into the developers, the suction of the developing device becomes too strong, thereby deteriorating the toner image when the carrier device 22 sucks and carries the record paper, (although it is possible to form a toner image when the carrier device 22 does not suck and carry the recording paper). Further, if such deterioration of the toner image is to be prevented, the suction of the developing device becomes too weak when the carrier device 22 does not suck and carry the recording paper, thereby causing toner dispersion and the mixing of the different color toners into each of a plurality of the developing device in the color image recording apparatus.

According to the image recording apparatus of the present invention, a common air blower is used as the suction means to prevent toner dispersion of the developing device as well as the suction means for sucking the recording paper of the carrier device, and it is possible to prevent toner dispersion without any deterioration of the toner image by the suction means of the developing device whether the carrier device sucks the recording paper or not.

What is claimed is:

1. An air flow control system for an image recording apparatus, comprising:

a rotatable image retainer for carrying a latent image thereon;

developing means for developing said latent image to obtain a toner image;

a recording medium;

means for transferring said toner image to said recording medium;

carrying means for carrying said recording medium with said toner image thereon;

first suction means for preventing toner dispersion from said developing means;

second suction means arranged in said carrying means for providing suction to carry said recording medium;

air flow control means for dynamically controlling the suction in both said first and said second suction means; and detection means for generating a detection output signal which indicates whether said second suction means is carrying said recording medium; and said air flow control means dynamically controlling suction to both said first and said second suction means responsive to said detection output signal.

2. The system according to claim 1, wherein said detection means detect static suction pressure and wherein said air flow control means comprises an air blower.

3. The system according to claim 1, further comprising a suction inlet in said carrying means; said detection means being arranged in said suction inlet; and said detection means detecting the presence of said recording medium.

* * * * *